US005152708A

United States Patent [19]

Claugus et al.

[11] Patent Number: 5,152,708

[45] Date of Patent: Oct. 6, 1992

[54] VIBRATION MECHANISM WITH ATTITUDE SENSING SWITCH

[75] Inventors: Dan Claugus, 14532 Fire Lake Rd., Eagle River, Ak. 99577; Jeffrey T. Liles, Anchorage, Ak.

[73] Assignee: Dan Claugus, Eagle River, Ak.

[21] Appl. No.: 793,790

[22] Filed: Nov. 18, 1991

[51] Int. Cl.[5] ..... A63H 11/02; A63H 29/22; A61H 1/00

[52] U.S. Cl. ..... 446/3; 446/484; 128/32

[58] Field of Search ..... 446/3, 484, 485, 29; 128/32, 34, 35, 36, 41, 42, 43

[56] References Cited

U.S. PATENT DOCUMENTS

| | | | |
|---|---|---|---|
| 2,849,819 | 9/1958 | Murphy et al. | 446/485 X |
| 4,093,944 | 6/1978 | Muncheryan | 128/32 X |
| 4,125,962 | 11/1978 | Torrejon et al. | 446/484 |
| 4,257,408 | 3/1981 | Ramey | 128/32 |
| 4,536,167 | 8/1985 | Hughes | 446/358 X |
| 4,718,876 | 1/1988 | Lee | 128/41 X |
| 5,074,820 | 12/1991 | Nakayama | 446/29 |

FOREIGN PATENT DOCUMENTS

| | | | |
|---|---|---|---|
| 2254185 | 7/1975 | France | 446/484 |

*Primary Examiner*—D. Neal Muir
*Attorney, Agent, or Firm*—George Wolken, Jr.

[57] ABSTRACT

The present invention is a combination of a motor having an unbalanced load thereon and an attitude switch (typically a mercury switch) in the activating circuit of the motor. The motor and the switch are securely attached to a substantially rigid framework in such a manner that, when in its stable horizontal position, the switch is in its off position and no motion of the motor, framework or switch occurs. When disturbed from the stable horizontal position, the switch closes the electrical activation circuit for the motor, resulting in vibration of the motor, switch and framework. This vibration causes the switch to be frequently, but not continuously, in the on position sustaining thereby the vibrational motion of the unit indefinitely until the framework (and the motor and switch securely attached thereto) is firmly held in the horizontal position for a brief period of time, typically a few seconds, causing the switch to come to rest once again in the stable off position. Such vibration mechanism may be used to impart amusing motion to a toy or other novelty item.

6 Claims, 2 Drawing Sheets

VIBRATION MECHANISM WITH ATTITUDE SENSING SWITCH

BACKGROUND OF INVENTION

The present invention relates to the field of mechanical vibration mechanisms. In particular, the present invention relates to a device for producing an apparently random vibrational motion, in combination with a means for initiating and terminating such motion, without an external on-off control switch as would find application typically in toys and similar novelty items.

Toys and novelty items are frequently manufactured with the capability to undergo a vibrational motion, adding thereby to the amusement value and consumer appeal. Several examples exist of different means to produce such vibrational motion, as well as several examples of switch devices for initiating and terminating such vibration.

The work of Richard (French patent 2,254,185) describes a toy in the shape of a dog's bone. Vibrational motion is produced by the rotation of a small, battery operated, electric motor inside such bone. The motor rotates an unbalanced load such that the resulting motion causes the motor to vibrate in an apparently random manner when activated. Having this motor attached to the interior surface of the bone causes the entire device to vibrate when activated. The activation means for this device comprises a simple pressure-activated switch positioned in such a location as to make contact and activate the motor when the bone is compressed, typically to a dog's chewing. The resulting vibration of the bone continues for as long as the bone is compressed and terminates at once when compression is removed.

The invention of Halvorson et. al. (U.S. Pat. No. 3,530,617) also uses unbalanced rotation to produce vibration in a toy. However, this invention coordinates two motors rotating at predetermined speeds to impart rotational centrifugal forces to a toy vehicle. The resulting coordinated motion causes the vehicle to move forward. The novelty appeal of this device seems to lie in the generation of forward motion without any apparent external means of propulsion (such as a drive wheel, tread, etc.)

The invention of Martin (U.S. Pat. No. 4,438,588) uses a mercury switch to sense the orientation of a remote controlled ball. Such a mercury switch is used to turn off power when the ball (and toy vehicle contained therein) is inverted.

Hughes (U.S. Pat. No. 4,536,167) discloses a toy using a motor with an unbalanced load to produce a vibrational motion similar to a rocking mechanism as would be used, or example, in a toy submarine. This invention makes use of two switches to control the activation of the motor. A mechanical switch is used in proximity to a asymmetrical inertial fly-wheel which closes intermittently as a protruding portion of said fly-wheel rotates into contact with said switch. The toy also makes use of a mercury switch (or other horizontal-sensing switch such as a ball-in-cage switch) as a mechanism to sense the deviation of the toy from horizontal. Said mercury switch is connected in parallel with said mechanical switch to produce continuous motion.

In contrast to these inventions the present invention uses a single attitude switch (typically a mercury switch) in combination with an unbalanced rotational load. The positioning of the mercury switch is chosen such that, when at rest on a horizontal surface, the object remains at rest indefinitely with no battery drain and no work being performed by the motor. However, when disturbed, the present invention continues in motion indefinitely until there is active intervention by the user. This active intervention take the form of firmly holding the object in a horizontal position for sufficient time that the mercury switch comes to rest in the off position. Thus, the present invention produces no motion until disturbed. Once set in motion, it remains in motion indefinitely. The object returns to rest only when firmly held at rest for (typically) 1 or 2 seconds. All this is accomplished with a single mercury switch internal to said object, and no external switches of any kind. This allows the entire mechanism to be permanently sealed inside a container such as a toy or a can. Except to change the battery, there is no need for the user to have any access whatsoever to the interior of such toy. A typical use for this mechanism is in a toy, substantially in the shape of a standard food can, carrying a label such as "canned earthquake". The novelty amusement value lies in part in the lack of an external switch and the cans apparent "obedience" to physical quieting by the user.

SUMMARY AND OBJECTS OF THE INVENTION

The present invention comprises a motor having an unbalanced load thereon an attitude switch (typically a mercury switch) in the activating circuit of said motor, wherein said motor and said switch are securely attached to the interior of a container in such a manner that, when in a stable horizontal position, said switch is in the off position and no motion of said motor, container or switch occurs; and when disturbed from said stable horizontal position, said switch closes the electrical contact, and the resulting vibration of said motor, switch and container causes said switch to be frequently, but not continuously, in the one position, sustaining thereby said vibrational motion indefinitely, until said container (and said motor and switch securely attached thereto) is firmly held in the horizontal position for a brief period of time, typically a few seconds, causing said switch to come to rest once again int he stable off position.

A primary object of the present invention is to cause vibrational motion of a container for an indefinite period of time, controlled without an electrical switch external to said container.

Another object of the present invention is to produce a toy and novelty item which will remain at rest until displaced from its resting position; vibrate indefinitely until firmly held at rest in its stable position for a brief period of time.

Another object of the present invention is to produce a novelty item which is apparently hermetically sealed but produces vibrational motion when disturbed from its equilibrium resting position.

DESCRIPTION OF PREFERRED EMBODIMENTS

Figure 1:
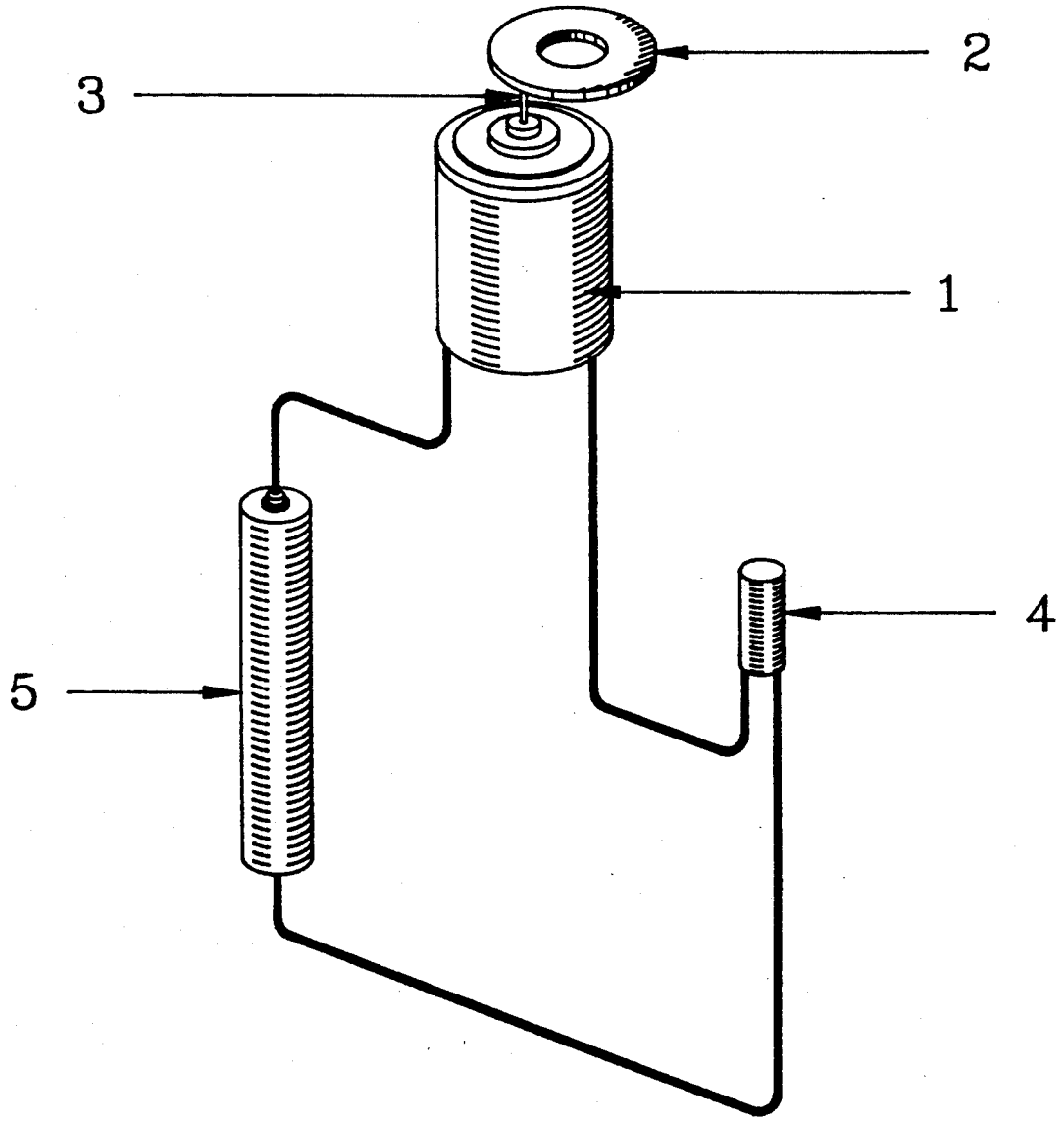
FIG. 1: A schematic, exploded view of the vibratory and switch mechanism.

FIG. 1 shows a schematic view of the vibrational mechanism of the present invention and the switching mechanism. We describe here our preferred mode of practicing the present invention, not excluding other possible means of carrying out the essential features hereof as would be obvious to those having ordinary skill in the art.

A motor, 1, is typically used to create the vibrational motion by means of an unbalanced weight, 2, attached to the rotor shaft, 3, of said motor. The motor is typically powered by a battery 5, connected to motor 1 by a circuit including an attitude switch, 4. Switch 4 would typically be a mercury switch or another form of attitude switch.

Figure 2:
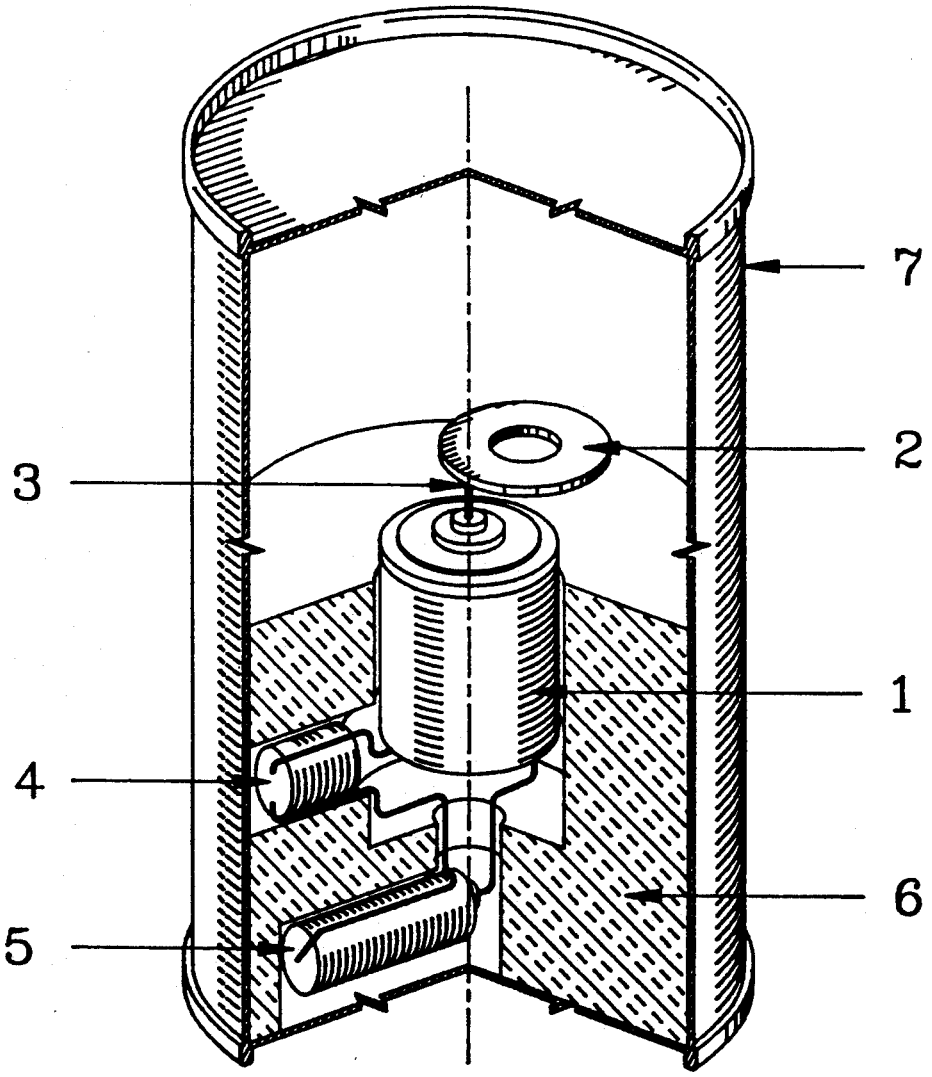
FIG. 2: A cut-away view of a novelty can structure showing the present invention securely mounted in the interior thereof.

FIG. 2 shows a typical mode in which the vibration and switching mechanism of FIG. 1 would be used in conjunction with a toy. The motor, 1, and attitude switch, 4 are securely connected to the structure of the toy, 7. This is typically performed by means of mounting said motor, 1 and said switch, 4 to a piece of filler material, 6, typically a polymer or foam such as polyurethane. The function of filler material 6 is to provide a mechanical connection between motor, 1, switch, 4, and toy 7, such that when rotating unbalanced load 2, all three items vibrate simultaneously. Typically, filler material would be formed to fill securely in one direction the interior space of toy, 7, making thereby a secure mechanical contact with toy, 7, while leaving free space along the another direction of toy, 7 for unimpeded rotation of load, 2. The battery, 5, need not be securely mounted to filler material, 6, but it is typically convenient to do so.

An important feature of the present invention is the position of switch, 4. When toy, 7, is at rest in its normal, horizontal position, switch, 4 will be in the off position, allowing no current to reach the motor and allowing the toy to remain stably at rest. However, when displaced from this stable, horizontal position, switch 4 closes the circuit to the motor, and vibration begins.

Another important feature of the present invention is that the vibration of the motor, 1, toy, 7, and switch, 4, is sufficient for switch, 4, to be brought intermittently to its on position. This "intermittent on" of switch 4 is sufficient for motor, 1, to rotate briefly, causing weight, 2, to rotate. The rotational inertia of weight, 2, is sufficient for vibration of motor, 1, toy, 7, and switch, 4 to continue for a brief time even when switch 4 is intermittently brought to its off position. Thus, the vibration motion of the present invention is sustained by a series of intermittent rotations of motor, 1, and weight, 2. The rotational inertia of such motions is sufficient to cause switch, 4, to reach its on position over and over again in definitely, limited only by the lifetime of motor, 1 and battery 5.

Another important feature of the present invention is the method for stopping vibrational motion and bringing the toy, 7, once again to equilibrium at rest. This is simply accomplished by securely grasping toy, 7, and physically holding it rigidly in the horizontal position for a brief period of time (typically, 1 or 2 seconds). This external restraint prevents rotational inertia of load, 2, from causing motion of switch 4. Thus, switch 4 remains in its off position for sufficient time for load, 2, also to come to rest. This external imposition of physical restraint eliminates the feedback cycle of "switch 4 briefly on causing rotation of weight 2 causing switch 4 to be briefly on, etc., etc.".

In summary, the present vibrational mechanism and switching mechanism is simply accomplished by correct positioning of a mercury or similar attitude switch. The motion beings and ends by user intervention to the external surface of the can without any apparent external means for controlling the vibration (such as a button, switch, etc.) In contrast to the dog bone of Richards, the present invention will vibrate indefinitely once started without further contact by the user. User contact of a particularly amusing type (physically restraining the seemingly "out-of-control" toy) is required to cause the motion to stop.

Active intervention by the user takes the form of grasping the toy and physically restraining it at rest until it becomes quiet. Clearly, the vibration mechanism will cease only when the toy is restrained in a position having switch 4 in the open position. Restraint in any other position will merely present the can from executing visible vibrations, but it will still be "alive" and vibrating to the touch. Thus, it is a key feature of the present invention that, when rigidly restrained in the normal position for doing so (for example, the normal upright resting position of a can), the switch 4 is open and will remain so when the clamping force is removed after a period of time. Clamping, or causing the motion to be damped by external damping forces in any position other than the open position for switch, 4, will not cause the desired effect of "quieting" the toy as vibration will continue according to the mechanism explained herein.

We claim:

1. A vibration mechanism comprising:
   a) an unbalanced weight rotated by an electric motor, and
   b) an attitude switch in the circuit activating said motor, said switch joined to said motor by a mechanical connecting means such that vibration of said motor causes concurrent vibration of said switch, and
   c) wherein vibration of said switch by said motor causes intermittent opening and closing of said switch in said activating circuit, and
   d) wherein said unbalanced weight rotated by said motor imparts sufficient inertia when driven by said motor to cause vibration of the switch away from its open position sufficient to close said switch, again activating said motor and causing apparently continuous vibration, said vibration continuing indefinitely until an external clamping means causes said switch to remain at rest in the open position.

2. A vibration mechanism as in claim 1, further comprising a substantially rigid framework to which said motor and said switch are securely attached wherein said framework has an equilibrium resting position when placed on a substantially horizontal surface and said framework has mass and shape allowing vibration thereof when the vibration mechanism rigidly attached thereto is activated.

3. A vibration mechanism as in claim 2 wherein said switch has an orientation such that said switch is open when said framework is at rest in the equilibrium resting position of said framework.

4. A vibration mechanism as in claim 2 wherein said vibration ceases when said framework is rigidly clamped in its equilibrium resting a position for a brief period of time by the intervention of a clamping force external to said framework and said vibration mechanism.

5. A vibration mechanism as in claim 1 wherein said attitude switch is a mercury switch.

6. A vibration mechanism as in claim 1 wherein said switch is a ball-in-cage switch.

* * * * *